United States Patent [19]

Reiter

[11] Patent Number: 4,676,031

[45] Date of Patent: Jun. 30, 1987

[54] ELONGATED SANDING DEVICE

[76] Inventor: John P. Reiter, 10407 Quebec Ave. So., Bloomington, Minn. 55438

[21] Appl. No.: 902,186

[22] Filed: Aug. 29, 1986

[51] Int. Cl.[4] ..... B24D 15/00

[52] U.S. Cl. ..... 51/392; 51/358

[58] Field of Search ..... 51/358, 391, 392, 393, 51/205 R; 29/80; 16/110 R, 111 R

[56] References Cited

U.S. PATENT DOCUMENTS 1,921,211 8/1933 Bawden ..... 51/391

2,434,356 1/1948 Finkelstein ..... 51/392

4,137,370 2/1979 Goralski ..... 51/392

*Primary Examiner*—Frederick R. Schmidt

*Assistant Examiner*—Maurina Rachuba

*Attorney, Agent, or Firm*—Vidas & Arrett

[57] ABSTRACT

An elongated, rigid sanding device comprising a pair of elongated, channel-shaped members which are hingedly mounted together adjacent their ends by their side channels. Handles are attached to the upper channel-shaped member. A biasing spring mechanism is provided between the bases of the channel-shaped members to keep the sanding surface generally planar.

6 Claims, 3 Drawing Figures

3
3

ELONGATED SANDING DEVICE

FIELD OF THE INVENTION

This invention relates to elongated, rigid sanding devices and more particularly to sanding blocks for use in automotive finishing.

BACKGROUND OF THE INVENTION

Sanding blocks typically employ a rigid solid block of material to which an abrasive sheet is attached. An operator then grasps the handles of the block and provides a sanding action by supplying reciprocating, rectilinear, oblique or broadside motion to the block.

When long surfaces are to be sanded the operator needs to have a much greater skill in order to prevent the appearance of ripples or waves caused by the sanding. A longer sanding block will decrease the tendency to cause waves or ripples in the finished surface. However, longer sanding blocks greatly increase the weight of the sanding tool which makes it unwieldly and very difficult to operate. Additionally, the application of pressure at remote ends of long sanding blocks tends to deform the surface to which the sand paper is adhered. This in turn means that use of the tool will cause an uneven finish to be obtained. Repeated use of an elongated sanding block also tends to create a "set" in the tool such that the middle of the tool intermediate the ends tends to be bowed upwardly.

BRIEF SUMMARY OF THE INVENTION

The sanding device of the invention is formed from an elongated channel-shaped base member. A resilient pad overlays the relatively rigid elongated surface of the base member. A sheet of abrasive material is secured to the generally planar surface of the resilient pad by adhesive or the like.

An elongated channel-shaped upper member having a top and channel sides is hingedly joined to the lower base member. Channel sides of the base member and upper member are joined together by hinges which provide at least two remotely spaced pivot points lengthwise, between the channel sides. The upper member supplies additional rigidity to the base member while at the same time providing little extra weight. The hinge mechanism joining the base member and upper member by the sides of the channels creates a floating attachment. One or more springs are positioned between the base member and upper member intermediate the ends of the channel members. The application of pressure to the base member intermediate the hinges is countered by pressure applied by the springs which attempts to restore the base to a generally planar surface. Without the inclusion of this constant biasing force repeated use of an elongated sanding device would tend to create a permanent set in the shape of a bow intermediate the ends. The spring biasing device will actually restore a planar surface of the base member during use and would prevent a "set" from forming.

A pair of upstanding handles may be positioned upon the surface of the upper member so as to form a front and rear handle. An operator may then utilize the tool placing a hand on each handle. Alternatively, a pair of attachment lugs may be fastened to the upper member adjacent each end for attachment to a powered reciprocating device to provide power-driven rectilinear, reciprocating motion.

The advantages of this invention are primarily achieved when the sanding block has an abrasive surface length of greater than about 16 inches. Whenever sanding devices are made about 16 inches in length or greater, rigidity could previously be obtained only by greatly increasing the weight. Operators would have great difficulty in handling such heavy devices. The invention allows sanding devices to be made greater than 16 inches in length which are still light weight enough to allow an operator to easily handle and accurately control the tool. The unique biasing spring mechanism of the invention insures that the desired flat sanding surface will be maintained over a long period of time.

BRIEF DESCRIPTION OF THE DRAWINGS

A detailed description of the invention is hereafter described with specific reference being made to drawings in which.

DETAILED DESCRIPTION OF THE INVENTION

Figures 1, 2, 3:
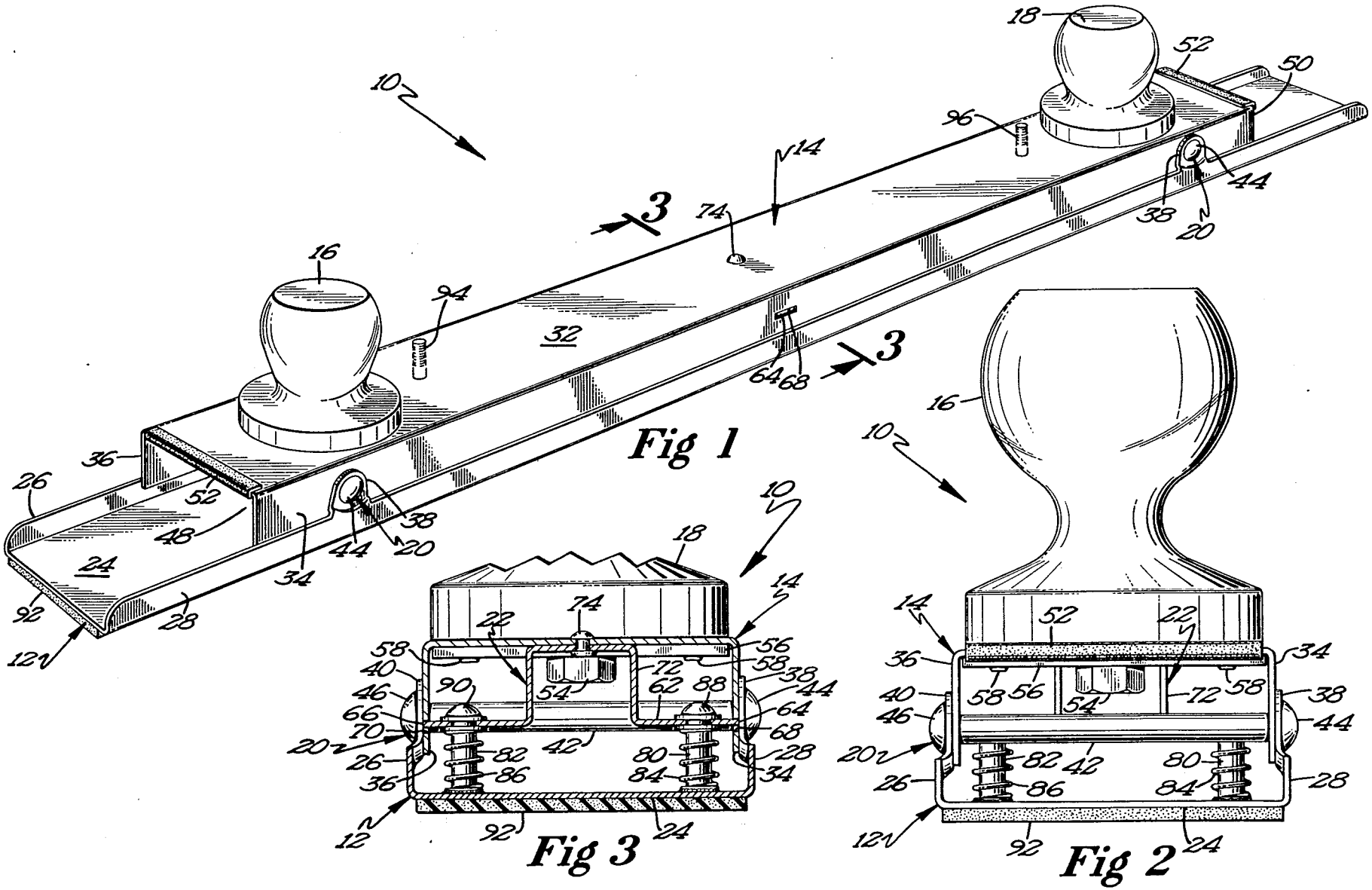
FIG. 1 is a perspective view of the sanding device of the invention.
FIG. 2 is an end view of the sanding device of FIG. 1.
FIG. 3 is a cross-sectional view of the device of FIG. 1 through lines 3—3.

Sanding device 10 of the invention as shown in FIGS. 1-3, includes a channel-shaped base member 12, channel-shaped upper member 14, front and rear handles 16 and 18 respectively, hinges 20 and a biasing mechanism 22.

Base member 12 is channel-shaped and includes a lower planar base 24, and channel sides 26 and 28. As shown in the figures, base member 12 is elongate and preferably has a length of at least 16 inches. Whenever sanders are manufactured such that the total length exceeds 16 inches, the combination of length, weight and stability of the tool presents a problem if the device is rigid enough for a usable tool. Weight becomes a severe problem if the device is rigid enough to present a usable tool. In devices of less than 16 inches weight is not as critical and the necessary rigidity may be achieved by using heavy stiffeners.

The channel-shaped upper member 14 includes an upper planar surface 32 and downwardly extending channel sides 34 and 36.

Channels sides 26 and 28 of base member 12 include upstanding tabs 38 and 40 respectively. Base member 12 and upper member 14 are hingedly joined together by hinge pins 42 which pass through an opening in the tabs and in channel sides 34, 36 of upper planar surface 32 as shown. Hinge pin 42 may be held in place by caps 44 and 46 respectively. As a result, base member 12 is hingedly mounted to upper member 14 by way of the channel sides of each member. This provides increased rigidity to the base member while allowing the span between the remotely spaced hinge pins to flex. Preferably, as shown in FIG. 1, hinges 20 are placed adjacent ends 48 and 50 of upper member 14. As shown, ends 48 and 50 may be covered with an end cap 52 made of rubber or plastic so as to prevent the user from contacting the sharp edge of ends 48 and 50.

Handles 16 and 18 are attached to upper planar surface 32 of upper member 14. As shown, handles 16 and 18 are attached by means of a bolt (not shown) and a nut 54. In the form shown, a stiffening plate 56 is positioned directly beneath each handle. Bosses 58 prevent handle 16 from twisting. This stiffening plate 56 provides additional rigidity and strength at the attachment point of the handles.

Biasing mechanism 22 includes a stiff metal strap 62 having ends 64 and 66 which extend through slot 68 and 70 of channel sides 34 and 36. Strap 62 includes a U shaped section 72 which may be rigidly secured to upper planar surface 32 of upper member 14. As shown, U-shaped section 72 is riveted by rivet 74 to upper member 14. However, it has been found that the only connection required is supplied by ends 64, 66 extending through slots 68, 70. No rivet 74 is required. A pair of studs 80 and 82 are rigidly secured to lower planar base 24 as shown. Studs 80 and 82 may be spot welded or otherwise rigidly attached to lower planar base 24. A spring 84 and 86 is placed over each stud as shown and the ends of the studs are capped with caps 88 and 90. Studs 80 and 82 pass through openings in metal strap 62 as shown.

The construction of biasing mechanism 22 allows lower planar base 24 to flex upwardly toward upper member 14. However, as soon as sanding device 10 is removed from contact with a workpiece, springs 84 and 86 rebound such that lower planar base 24 is again generally planar. In this manner there is always a countervailing pressure applied to the central portion of base member 12 in order to keep lower planar base 24 flat. This provides greater accuracy in the sanding and prevents a "set" from developing in the device. Although one biasing mechanism is shown several may be disposed between the hinge points to provide biasing action. As shown, sanding device 10 includes a thin rectangular pad 92 of plastic or rubber which is fixed to the lower planar base 24. Sand paper is then applied to that surface with the aid of a pressure sensitive adhesive or by clamps.

The construction of the sanding device allows the production of sanders which can exceed three feet in length. The opposing, lightweight channels provide very good rigidity and a low, manageable weight. The intermediate biasing mechanism between the hingedly mounted channel members prevent the elongated sander from obtaining a set and insures that the sanding surfaces of the device remain in a generally planar configuration.

Although the sanding device described above is the preferred embodiment, it should be appreciated that many changes could be made without departing from the spirit of the invention. For example, instead of knob-like front and rear handles, device 10 may be connected to a hydraulic or electric device which will supply reciprocating, rectilinear motion to the device. Fastening studs 94, 96 as shown would be present instead of knobs 16, 18 if the device is to be attached to a power source. The light-weight of the device of the invention will be particularly important if the device is to be powered by hydraulics or electrically since the addition of a power unit itself adds significant weight. Without the light weight device of the invention it is virtually impossible to control a stiff, two foot long sanding device which is connected to power unit.

In considering this invention, it must be remembered that the disclosure is illustrative only and that the scope of the invention is to be determined by the appended claims.

What is claimed is:

1. A sanding device for providing sanding of long surface areas, the device comprising:

(a) an elongated channel-shaped base member having a base and channel sides;

(b) means for adhering sandpaper to the base of said channel-shaped base member;

(c) an elongated channel-shaped upper member having a top and channel sides;

(d) joining means for joining said elongated base member to said elongated upper member, said means providing at least two remotely spaced pivot points between the side channels of said base member and upper member;

(e) means for biasing said base member from said upper member such that said base member remains substantially planar; and (f) handle means attached to said upper member for providing an operator with handholds.

2. A sanding device comprising:

(a) an elongated, channel-shaped base member having a firm, elongate surface, and channel sides;

(b) a firm, resilient pad overlaying said firm surface against which a sheet of abrasive material may be secured;

(c) an elongated, channel-shaped upper member having a top and channel sides;

(d) joining means for hingedly joining said channel sides of said upper member to said lower member channel sides adjacent the ends of said upper and base members; and (e) means for biasing said base member from said upper member such that said firm, elongate surface of said base member remains generally planar after use.

3. The device of claim 2 further including:

(f) handle means including front and rear handles upstanding from said upper member opposite said firm elongate surface, with each of said handles adjacent a different one of its ends.

4. The device of claim 2 further including:

(f) means for attaching a power driven, reciprocating tool to said upper member opposite and superior said firm elongate surface of said base member so as to provide powered, reciprocating movement to said device.

5. The device of claim 2 wherein said joining means includes hinges connecting the sides of said base member and upper member channel sides together adjacent each end of said upper member and base member.

6. The device of claim 5 wherein said biasing means includes spring means including at least one spring mounted between said base member and upper member intermediate said hinges so as to aid in restoring the generally planar surface of said firm elongated surface and to prevent a set from occurring to said base member.

* * * * *